US007785170B2

(12) United States Patent
Chernick et al.

(10) Patent No.: US 7,785,170 B2
(45) Date of Patent: Aug. 31, 2010

(54) NOVELTY DEVICE HAVING ELASTOMERIC PROTRUSIONS WITH HARD PLASTIC TERMINATIONS AND ITS ASSOCIATED METHOD OF CONSTRUCTION

(76) Inventors: Mark J. Chernick, 19180 144th Ave., NE., Woodinville, WA (US) 98072; Webb T. Nelson, 19180 144th Ave., NE., Woodinville, WA (US) 98072

( * ) Notice: Subject to any disclaimer, the term of this patent is extended or adjusted under 35 U.S.C. 154(b) by 207 days.

(21) Appl. No.: 11/825,829

(22) Filed: Jul. 10, 2007

(65) Prior Publication Data

US 2009/0017721 A1 Jan. 15, 2009

(51) Int. Cl.
*A63H 33/00* (2006.01)

(52) U.S. Cl. ..... 446/486; 446/118; 446/119; 446/120; 446/121; 446/122; 446/123; 446/124; 446/125; 446/126; 446/85; 29/238; 473/575; 473/596; 277/376; 403/224; 403/300; 403/306

(58) Field of Classification Search ..... 446/118–126, 446/85, 486; 29/238; 473/575, 596; 277/376; 403/224, 306, 300
See application file for complete search history.

(56) References Cited

U.S. PATENT DOCUMENTS

| | | | | | |
|---|---|---|---|---|---|
| 1,198,263 | A | * | 9/1916 | Pajeau | 446/126 |
| 1,371,704 | A | * | 3/1921 | Miller | 473/594 |
| 2,020,484 | A | * | 11/1935 | Turner | 473/570 |
| 2,187,493 | A | * | 1/1940 | Gordon | 473/609 |
| 2,962,820 | A | * | 12/1960 | Petersen | 434/278 |
| 3,868,115 | A | * | 2/1975 | Faiferlick | 273/146 |
| 4,085,873 | A | * | 4/1978 | Schweitzer | 294/142 |
| 4,088,319 | A | * | 5/1978 | Clarke | 473/575 |
| 4,309,038 | A | * | 1/1982 | Spoon | 473/596 |
| 4,340,222 | A | * | 7/1982 | Kerkenbush et al. | 473/610 |
| 4,756,529 | A | * | 7/1988 | Stillinger | 473/614 |
| 4,781,644 | A | * | 11/1988 | Yoshida | 446/123 |
| 4,991,841 | A | * | 2/1991 | Paranto | 473/609 |
| 5,020,438 | A | * | 6/1991 | Brown | 102/517 |
| 5,129,560 | A | * | 7/1992 | Herman | 224/579 |
| 5,341,973 | A | * | 8/1994 | Dawes et al. | 224/196 |
| 5,577,732 | A | * | 11/1996 | Spector | 473/576 |
| 5,813,931 | A | * | 9/1998 | Gormley | 473/575 |
| 5,964,384 | A | * | 10/1999 | Young | 224/153 |
| D418,673 | S | | 1/2000 | Madsen | |
| 6,024,660 | A | * | 2/2000 | Romanick | 473/596 |
| 6,189,750 | B1 | * | 2/2001 | Von Neumann | 224/153 |

(Continued)

*Primary Examiner*—Gene Kim
*Assistant Examiner*—Alexander R Niconovich
(74) *Attorney, Agent, or Firm*—LaMorte & Associates

(57) ABSTRACT

A novelty device and the associated method of fabricating component parts of the novelty device. The novelty device has at least one protrusion that is made from an elastomeric gel. The protrusion has a distal end. A hole is disposed through the protrusion proximate its distal end. A secondary object is provided. The secondary object is made from a rigid material. The secondary object defines an interior space. The distal end of the elastomeric gel protrusion extends through the secondary object and into the interior space of the secondary object. The secondary object is comprised of an assembly of interconnecting parts. The parts of the secondary object are assembled around the elastomeric gel protrusion in the area of the hole. Once assembled, the secondary object engages the hole in the elastomeric gel protrusion. As a result, the secondary object becomes mechanically interconnected to the end of the elastomeric gel protrusion.

14 Claims, 4 Drawing Sheets

U.S. PATENT DOCUMENTS

| | | | | |
|---|---|---|---|---|
| D444,942 | S * | 7/2001 | Melnick | D3/216 |
| 6,280,356 | B1 * | 8/2001 | Sandeen | 473/614 |
| 6,336,576 | B1 * | 1/2002 | Easter | 224/153 |
| 6,348,534 | B1 * | 2/2002 | Bianco | 524/400 |
| 6,491,563 | B1 * | 12/2002 | Bailey | 446/122 |
| 6,568,982 | B2 * | 5/2003 | Esterle | 446/122 |
| D487,189 | S * | 3/2004 | Ukitsu et al. | D3/217 |
| D489,174 | S * | 5/2004 | Shigenaka et al. | D3/217 |
| 6,821,220 | B2 * | 11/2004 | Engler, Jr. | 473/578 |
| D499,882 | S * | 12/2004 | Baclawski | D3/216 |
| 7,165,869 | B2 * | 1/2007 | Chernick et al. | 362/363 |
| 2006/0014467 | A1 * | 1/2006 | Tusacciu | 446/126 |
| 2006/0052188 | A1 * | 3/2006 | Gormley | 473/575 |
| 2006/0073763 | A1 * | 4/2006 | Tsun et al. | 446/486 |
| 2006/0084355 | A1 * | 4/2006 | Wong et al. | 446/71 |
| 2006/0084357 | A1 * | 4/2006 | Rosen et al. | 446/91 |
| 2006/0128257 | A1 * | 6/2006 | Aggar | 446/122 |
| 2006/0146525 | A1 * | 7/2006 | Chernick et al. | 362/196 |
| 2007/0072512 | A1 * | 3/2007 | Chernick et al. | 446/369 |
| 2007/0072514 | A1 * | 3/2007 | Chernick et al. | 446/369 |
| 2007/0072515 | A1 * | 3/2007 | Chernick et al. | 446/385 |
| 2007/0135247 | A1 * | 6/2007 | Huber | 473/614 |
| 2007/0172802 | A1 * | 7/2007 | Adams et al. | 434/247 |
| 2007/0249469 | A1 * | 10/2007 | Chernick et al. | 482/44 |
| 2007/0270233 | A1 * | 11/2007 | Ruston | 473/280 |
| 2008/0132144 | A1 * | 6/2008 | Chernick et al. | 446/486 |
| 2009/0068924 | A1 * | 3/2009 | Chernick et al. | 446/397 |

* cited by examiner

NOVELTY DEVICE HAVING ELASTOMERIC PROTRUSIONS WITH HARD PLASTIC TERMINATIONS AND ITS ASSOCIATED METHOD OF CONSTRUCTION

BACKGROUND OF THE INVENTION

1. Field of the Invention

In general, the present invention relates to novelty devices and toys that are made in part, or in whole, of elastomeric gel. More particularly, the present invention relates to connection techniques that are used to join elastomeric gel to rigid material, such as hard plastic.

2. Prior Art Description

The use of elastomeric gels have become commonplace in the toy and novelty device industries. Elastomeric gels are typically made from a polystyrene copolymer that is mixed with a plasticizing oil, such as mineral oil. Depending upon the amount of plasticizing oil used, the elasticity of the elastomeric gel can be controlled. Elastomeric gels compositions exist that enable the elastomeric gel to stretch one thousand percent (1000%) without damage. Furthermore, elastomeric gels made from polystyrene copolymers are highly resistant to tearing. Accordingly, products made from such elastomeric gels are both highly elastic and highly resistant to breakage. This makes such elastomeric gel materials ideal for use with toys.

Elastomeric gel is a material that is either extruded or injection molded. Toys and novelties that contain elastomeric gel, therefore, tend to be made entirely of the elastomeric gel. Due to the fact that elastomeric gels are highly elastic and are slick with mineral oil, it is difficult to adhere other material to elastomeric gel. In the manufacturing of toy and novelty devices, it will be understood that component parts are very commonly connected using adhesives. However, conventional adhesives tend to pull away from elastomeric gel material, especially if the elastomeric gel material is repeatedly stretched. It is especially difficult to attach a rigid object to an elongated strand of elastomeric gel. This is because an elongated strand of elastomeric gel thins significantly as it is stretched. Furthermore, significant tensile forces can be experienced in a strand of elastomeric gel that is stretched to its limit. The thinning of the elastomeric gel and the tensile forces both act to detach the elastomeric gel from whatever object it was originally attached.

In the industries of toys and novelty devices, objects that separate from the original device can become choking hazards. The mere chance that an object can separate from a toy may result in the need for a product recall. A need therefore exists for an improved manner of attaching elastomer gel material to secondary objects in a more reliable manner.

SUMMARY OF THE INVENTION

The present invention is a novelty device and the associated method of fabricating component parts of the novelty device. The novelty device contains at least one protrusion that is made from an elastomeric gel. The protrusion has a distal end. A hole is formed through the protrusion proximate its distal end.

A secondary object is provided. The secondary object is made from a rigid material. The secondary object defines an interior space. The distal end of the elastomeric gel protrusion extends through the secondary object and into the interior space. The secondary object is comprised of an assembly of interconnecting parts. The parts of the secondary object are assembled around the elastomeric gel protrusion in the area of the hole. Once assembled, the secondary object engages the hole in the elastomeric gel protrusion within the interior space. As a result, the secondary object becomes mechanically interconnected to the end of the elastomeric gel protrusion.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention novelty device can have many configurations, in its simplest form, it can be formed as a ball. Accordingly, the shown exemplary embodiment of the present invention is presented as a ball in order to provide the best and simplest mode contemplated for the invention. However, it should be understood that the novelty device can function as described below if configured into shapes more complex than a ball.

Figure 1:
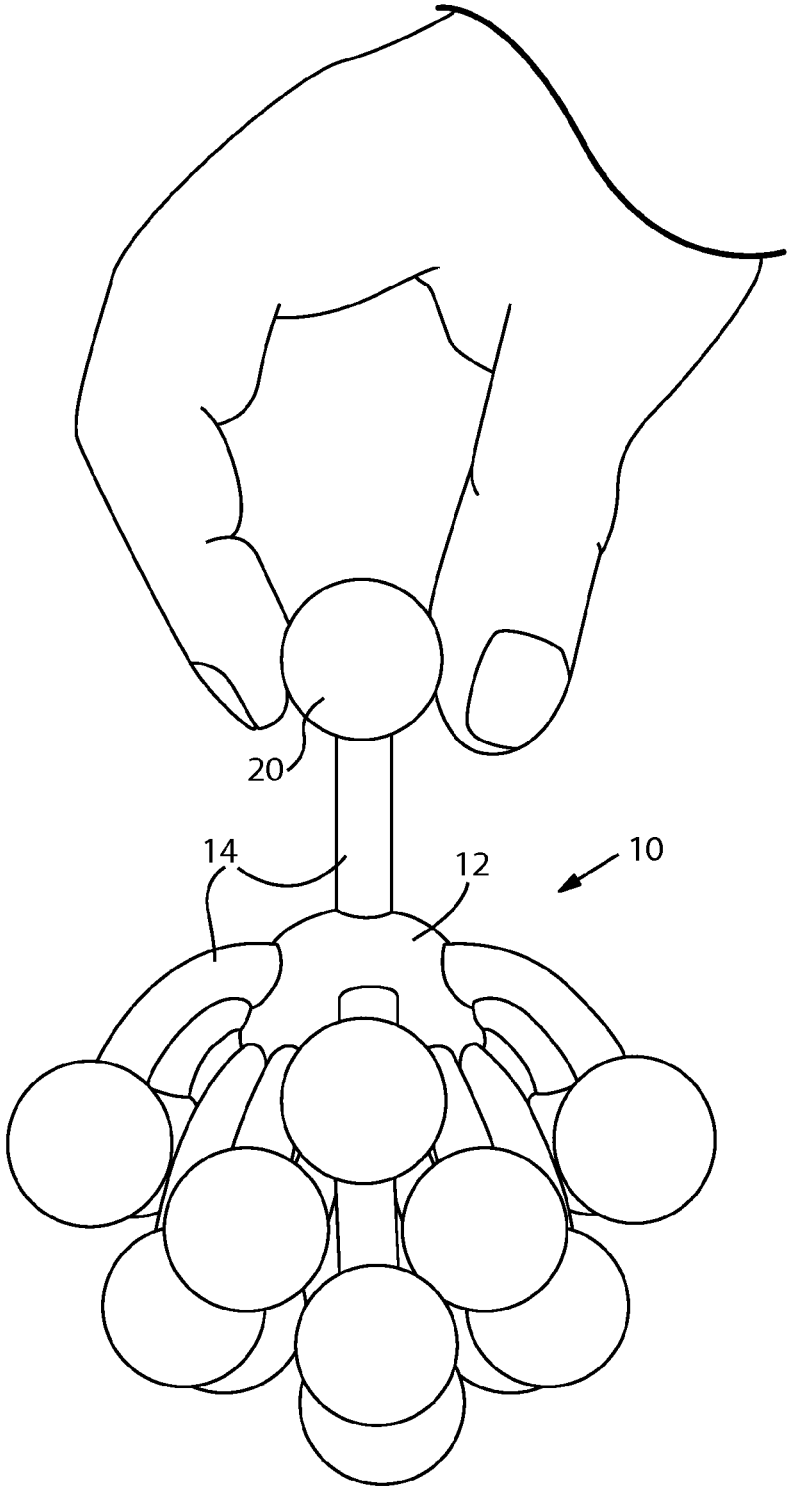
FIG. 1 is a perspective view of an exemplary embodiment of the present invention novelty device.

Referring to FIG. 1, the present invention novelty device 10 is embodied as a toy ball. The novelty device 10 includes a central hub 12. The central hub 12 can be either solid or hollow. In the shown embodiment, the central hub 12 is spherical in shape. However, such a shape is merely exemplary and it should be understood that other shapes can be used.

A plurality of protrusions 14 radially extend from the exterior of the central hub 12. The number, length, and thickness of the protrusions 14 can be varied as a matter of design choice. Both the central hub 12 and the plurality of protrusions 14 are made from a polystyrene elastomeric gel. It will therefore be understood that the central hub 12 and the plurality of protrusions 14 can be molded as a single-piece unit using standard injection molding techniques.

Each of the plurality of protrusions 14 has a distal end that terminates with a secondary object 20. The secondary object 20 is made of a rigid material, such as hard plastic. It will therefore be understood that the secondary objects 20 do not share the same elastic properties as the elastomeric gel of the central hub 12 and protrusions 14.

In the shown embodiment, the secondary objects 20 are small balls. The use of small balls is merely exemplary and it should be understood that secondary objects of many other shapes can also be used.

Figure 2:
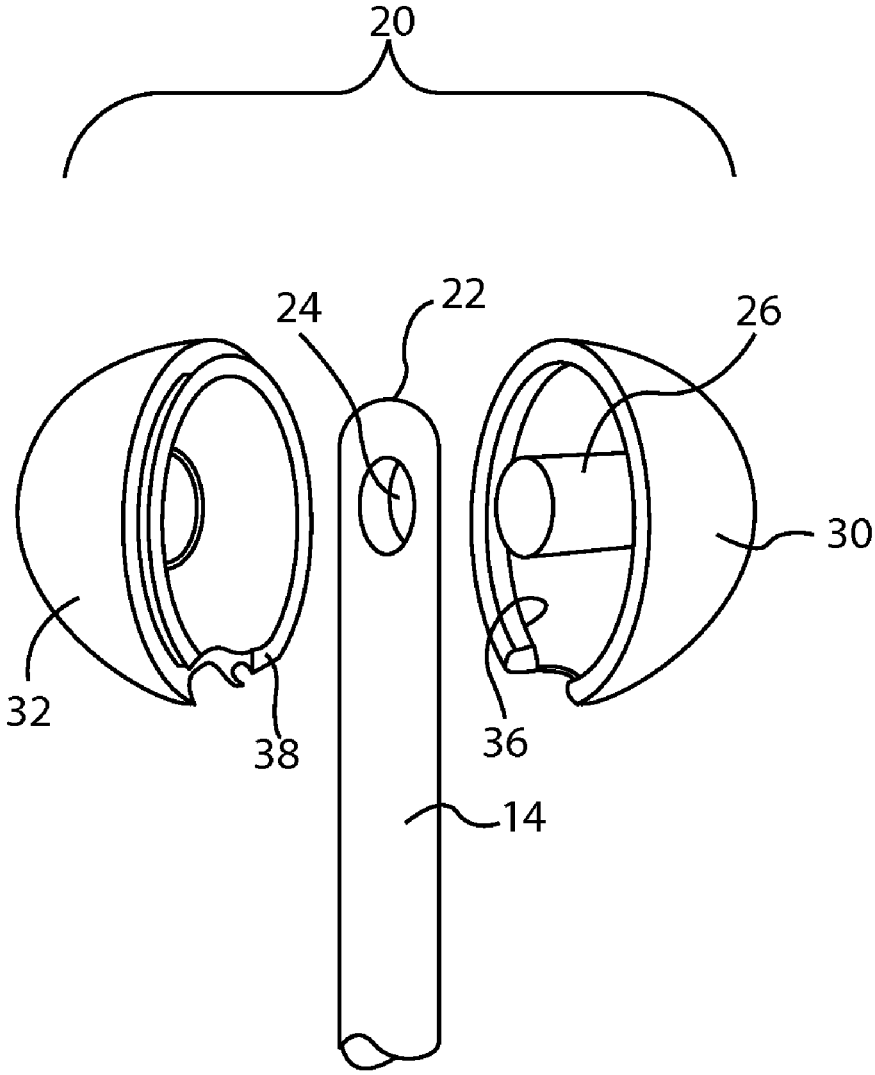
FIG. 2 is a perspective exploded view of an exemplary embodiment of a secondary object at the end of an elastomeric gel protrusion.
Figure 3:
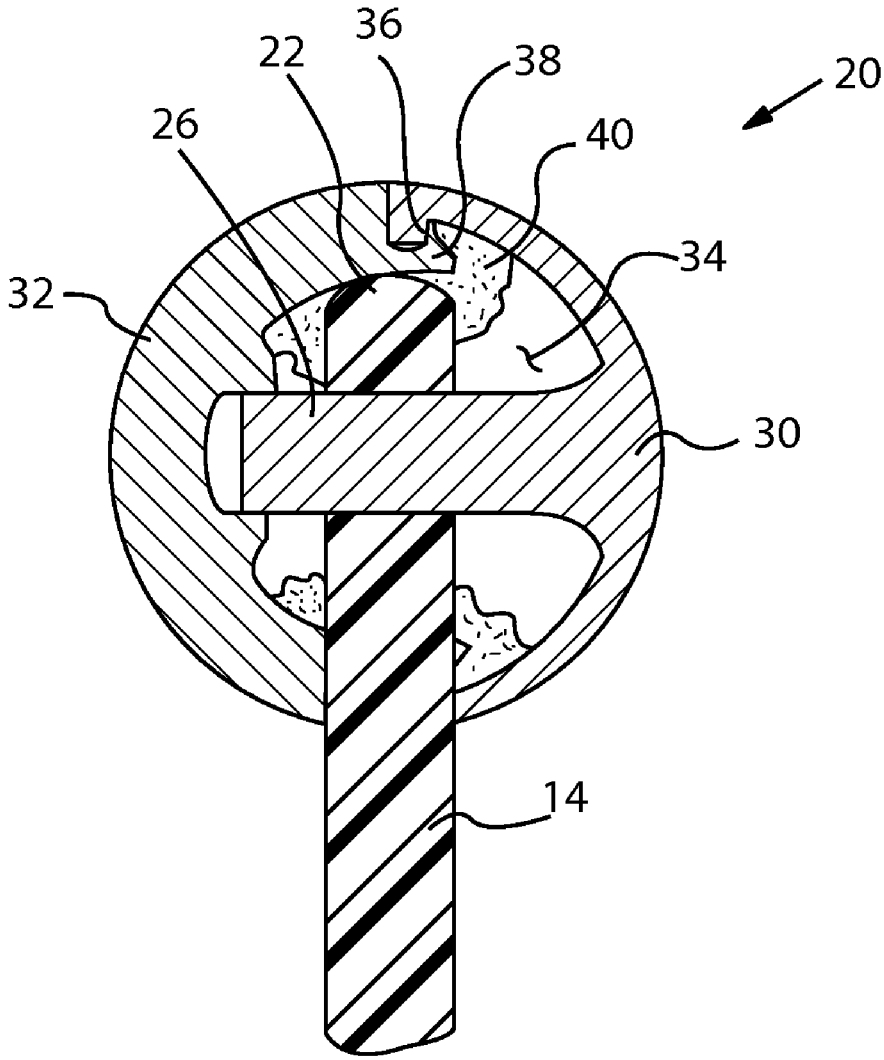
FIG. 3 is a cross-sectional view of an exemplary embodiment of a secondary object at the end of an elastomeric gel protrusion.

Referring to FIG. 2 in conjunction with FIG. 3, the attachment means used to connect the secondary objects 20 to the distal ends 22 of the protrusions 14 can be understood. A hole 24 is formed through each protrusion 14 near its distal end 22. The hole 24 can be created during the molding of the protrusion 14 or can be punched through the protrusion 14 in a secondary operation. The secondary object 20 is a two piece assembly that snaps together. A post 26 extends from a first piece 30 of the secondary object 20. The post 26 passes through the hole 24 in the protrusion 14 as the first piece 30 and the second piece 32 of the secondary object 20 are assembled. The result is a mechanical interconnection that prevents the distal end 22 of the protrusion 14 from being pulled out of the secondary object 20.

In the shown embodiment, each secondary object 20 has a first piece 30 and a second piece 32 that are shaped as hemispherical halves. When connected, the first and second pieces 30, 32 create a secondary object 20 that is shaped as a ball. When the two pieces 30, 32 are interconnected, the two pieces 30, 32 define an open interior space 34. The open interior space 34 is sized to enable the distal end 22 of a protrusion 14 to pass into the interior of the secondary object 20.

The first and second pieces 30, 32 of the secondary object 20 preferably snap together. Accordingly, one piece of the secondary object 20 contains a locking lip 36. The opposite piece of the secondary object 20 contains a pawl structure 38 that engages the locking lip 36 when the secondary object 20 is fully assembly. It will therefore be understood that once the two pieces 30, 32 of the secondary object 20 are assembled together, they cannot be separated in a non-destructive manner.

A dab of adhesive 40 is preferably placed in between the first and second pieces 30, 32 of the secondary object 20, prior to the assembly of the secondary object 20. The adhesive 40 fills the interior space 34 within the secondary object 20 around the distal end 22 of the protrusion 14 and in between the first and second pieces 30, 32. The adhesive helps to prevent the first and second pieces 30, 32 of the secondary object 20 from separating, even if the secondary object 20 were to become damaged.

In the shown embodiment, a single hole 24 is formed in the protrusion 14. Similarly, a single post 26 is shown in the secondary object 20 that passes through the single hole 24. The use of a single post 26 and a single hole 24 is exemplary. For larger protrusions and larger secondary objects, it should be understood that more than one hole can be formed in the secondary object. Likewise, a corresponding number of posts can be used to engage the holes.

Figure 4:
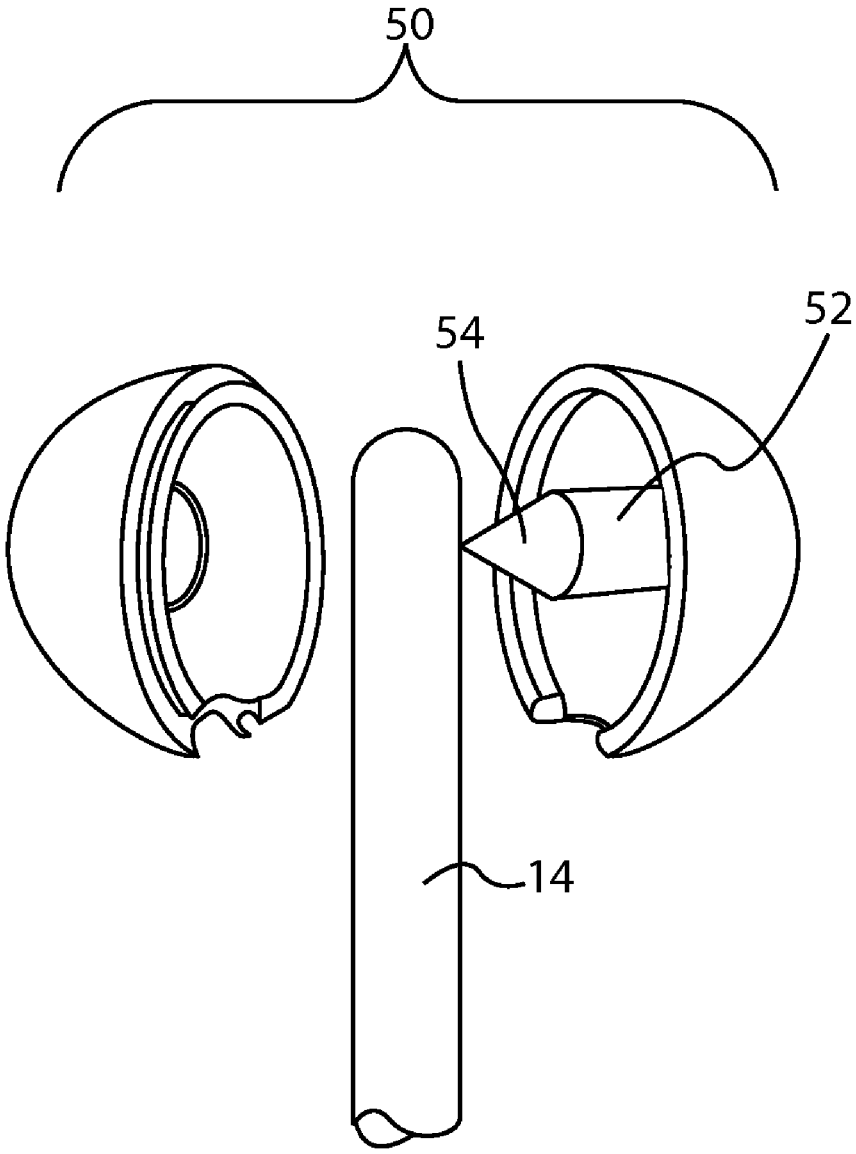
FIG. 4 is a perspective exploded view of an alternate embodiment of a secondary object at the end of an elastomeric gel protrusion.

In the embodiment of FIG. 2 and FIG. 3, the hole 24 is preformed in the protrusion 14. This need not be the case. Referring to FIG. 4, an alternate embodiment of a secondary object 50 is shown. The secondary embodiment 50 being illustrated is the same as that previously described, but with one exception. In the embodiment of FIG. 4, the post 52 has a sharpened point 54. When the secondary object 50 is assembled, the sharpened point 54 of the post 52 drives through the material of the protrusion 14, thereby making its own hole in the protrusion 14 and mechanically connecting the secondary object 50 to the protrusion 14.

It will be understood that the embodiment of the present invention novelty device that is shown is merely exemplary and that a person skilled in the art can make many variations to the embodiment without departing from the intended scope of the invention. For instance, it will be understood that the shown design of a novelty ball is exemplary. The present invention can be adapted for use with any toy having elastomeric gel protrusions, such as toys with elastomeric hair strands. Furthermore, the secondary objects can be formed in any shape, and need not be balls. The exterior shape of the secondary object is a matter of design choice. What is important is that the secondary object have pieces that close together over the distal end of an elastomeric gel protrusion. All such modifications, variations, and alternate embodiments are intended to be included within the scope of the present invention as defined by the claims.

What is claimed is:

1. A novelty device, including:

a central hub;

a plurality of flexible protrusions radially extending from said central hub, wherein each flexible protrusion contained within said plurality of flexible protrusions is molded entirely from an elastomeric gel material, each said flexible protrusion having a distal end, wherein a hole is disposed through said flexible protrusion proximate said distal end; and a secondary object made from a rigid material and coupled to said distal end of each of said flexible protrusions, wherein each said secondary object defines an interior in which a post is disposed, wherein said distal end of one of said flexible projections extends into said interior, and wherein said post engages said hole in said flexible protrusion within said interior, therein binding said secondary object to said flexible protrusion so that said secondary object terminates said flexible protrusion and each said secondary object hangs freely suspended by one of said flexible projections.

2. The device according to claim 1, wherein said post extends through said hole in said protrusion.

3. The device according to claim 1, wherein said secondary object includes a first piece and a second piece that interconnect to form said secondary object.

4. The device according to claim 3, wherein said first piece and said second piece connect together with a snap fit.

5. The device according to claim 3, further including adhesive in said interior, wherein said adhesive binds said first piece to said second piece.

6. The device according to claim 1, wherein said central hub is made of elastomeric gel and is integrally molded with said flexible protrusions.

7. The device according to claim 1, wherein said central hub is spherical.

8. The device according to claim 7, wherein said secondary objects are spherical.

9. The device according to claim 1, wherein each said post is pointed and forms said hole in said flexible protrusion as said secondary object is attached to said flexible protrusion.

10. A novelty device, including:

a hub;

at least two protrusions made from an elastomeric gel material, wherein each of said protrusions has a distal end; and a secondary object made from a rigid material for each of said protrusions, each said secondary object defining an interior containing at least one post, wherein said distal end of one of said protrusions extends into each said secondary object, and wherein said protrusion engages said at least one post within said interior, therein binding each said secondary object to said protrusions so that each of said protrusions are terminated by said secondary object, and each said secondary object hangs freely suspended by one of said flexible projections.

11. The device according to claim 10, wherein said at least one post extends through each of said protrusions.

12. The device according to claim 10, wherein said central hub is made of elastomeric gel and is integrally molded with said protrusion.

13. The device according to claim 12, wherein said central hub is spherical.

14. The device according to claim 13, wherein said secondary objects are spherical.

* * * * *